US007013683B1

(12) United States Patent
Walsh et al.

(10) Patent No.: US 7,013,683 B1
(45) Date of Patent: Mar. 21, 2006

(54) TURBINE-LIKE AIR-CIRCULATION ENHANCER FOR USE WITH A CLOTHES WASHING MACHINE

(76) Inventors: Eugene J. Walsh, 223 Wildwood Rd., Ronkonkoma, NY (US) 11779-4848; Patricia M. Walsh, 223 Wildwood Rd., Ronkonkoma, NY (US) 11779-4848

( * ) Notice: Subject to any disclaimer, the term of this patent is extended or adjusted under 35 U.S.C. 154(b) by 533 days.

(21) Appl. No.: 10/281,928

(22) Filed: Oct. 29, 2002

Related U.S. Application Data

(63) Continuation-in-part of application No. 09/905,840, filed on Jul. 16, 2001, now Pat. No. 6,497,121.

(51) Int. Cl.
*D06F 17/10* (2006.01)

(52) U.S. Cl. ..... 68/134

(58) Field of Classification Search ..... 68/134
See application file for complete search history.

(56) References Cited

U.S. PATENT DOCUMENTS

| | | | | | |
|---|---|---|---|---|---|
| 1,795,395 | A | * | 3/1931 | Hoke | 68/134 |
| 2,134,048 | A | * | 10/1938 | Kessel | 68/132 |
| 2,502,702 | A | * | 4/1950 | Castner | 68/134 |
| 2,579,393 | A | * | 12/1951 | Henry | 4/654 |
| 2,942,444 | A | * | 6/1960 | Abresch | 68/17 A |
| 2,976,711 | A | * | 3/1961 | Smith | 68/17 A |
| 3,285,040 | A | * | 11/1966 | Bochan | 68/134 |
| 3,648,486 | A | * | 3/1972 | Rosinski et al. | 68/4 |
| 3,702,069 | A | | 11/1972 | Sharpe | |
| 3,868,835 | A | | 3/1975 | Todd-Reeve | |
| 3,908,411 | A | * | 9/1975 | Fahmie | 68/23.7 |
| 3,948,064 | A | * | 4/1976 | Sauer et al. | 68/23.4 |
| 4,048,820 | A | | 9/1977 | Pielemeier | |
| 4,152,844 | A | | 5/1979 | Materniak, nee Balcerowicz et al. | |
| 4,452,054 | A | * | 6/1984 | Hafstrom | 68/133 |
| 4,977,690 | A | | 12/1990 | Davis, Jr. | |
| 5,239,847 | A | | 8/1993 | Lee | |
| 5,437,106 | A | | 8/1995 | Pardoe | |
| 5,440,903 | A | * | 8/1995 | Kropf et al. | 68/134 |
| 5,457,969 | A | * | 10/1995 | Roaf | 68/19.2 |
| 5,596,891 | A | | 1/1997 | Bae et al. | |
| 5,669,250 | A | | 9/1997 | Dausch et al. | |
| 5,765,406 | A | * | 6/1998 | Youn | 68/134 |
| 5,878,600 | A | | 3/1999 | Yeo et al. | |
| 5,921,114 | A | | 7/1999 | Jung | |
| 5,931,029 | A | | 8/1999 | Kim | |
| 6,006,446 | A | | 12/1999 | Pagendarm | |

FOREIGN PATENT DOCUMENTS

| | | | |
|---|---|---|---|
| JP | 60-179088 | * | 9/1985 |
| JP | 1-104293 | * | 4/1989 |
| JP | 1-250298 | * | 10/1989 |
| JP | 2-21897 | * | 1/1990 |

* cited by examiner

*Primary Examiner*—Frankie L. Stinson
(74) *Attorney, Agent, or Firm*—Donald R. Schoonover

(57) ABSTRACT

An accessory for a clothes washing machine includes a door having air flow ports and an air-circulation enhancer having a fan mechanism for mounting on top of an agitator of the clothes washing machine. The an mechanism has a turbine-like structure such that air is circulated along the agitator, through the air flow ports defined in the door, and then out other air flow ports in the door such that air circulation is enhanced over and around the clothes being centrifugally held against a tub wall during the spin-dry cycle of the clothes washing machine. The enhanced air circulation accelerates the drying process that occurs during the spin-dry cycle.

8 Claims, 7 Drawing Sheets

TURBINE-LIKE AIR-CIRCULATION ENHANCER FOR USE WITH A CLOTHES WASHING MACHINE

CROSS REFERENCE TO RELATED APPLICATION

This application is a continuation-in-part of U.S. application Ser. No. 09/905,840 filed Jul. 16, 2001, now U.S. Pat. No. 6,497,121.

BACKGROUND OF THE INVENTION

1. Field of the Invention

The present invention relates to the general art of textile fluid-treating apparatuses, and to the particular field of machines for treating textiles with combined operations, and most particularly to clothes washing machines.

2. Discussion of the Related Art

In the field of textile treating apparatuses, there are numerous designs for clothes washing machines and accessories therefor. Clothes are generally placed into such washing machines, washed, then rinsed, and then spin-dried. These machines generally have some sort of agitator to move the clothes in a desired manner to make the washing, rinsing and drying more efficient.

The spin dry cycle generally involves draining the wash tub of all water and then spinning the tub at a very high rate of speed with the agitator generally operating at a speed different from that of the tub. The spinning motion of the tub causes the clothes to move radially outward against the sides of the tub and then the centrifugal force squeezes the water out of the clothes.

This operation has worked well in the past. However, in recent times, the efficient use of energy has become more important. The inventor has discovered that the spin dry cycle of most presently available washing machines, while somewhat adequate, can be improved. This is especially evident when heavy clothes, such as jeans, or other heavy articles, such as towels, are washed. In many cases, these heavy articles are not dried as well as they could be during a spin dry cycle of a washing machine.

Because some articles are not dried as thoroughly as possible during the washing machine spin-dry cycle, such articles may require extra time in a dryer, or even repeated dryer cycles to fully dry them. This may be wasteful of energy. Furthermore, some articles that are washed in a washing machine are left in the machine for some time. If the articles are too wet, mildew may begin to form, which is not desirable. Still further, wet articles may not be as clean smelling as many people would like.

Therefore, there is a need for a clothes washing machine that has a spin dry cycle that has efficiency improved over the efficiency of presently available washing machine spin dry-cycles.

Many people who use washing machines have several tasks that they are performing simultaneously with the clothes washing/drying task. This situation creates a time management problem. These people do not want to waste time during the washing/drying task. In some instances, especially if the laundry load is heavy, the washing machine cycle is not completed in a timed relationship to a dryer cycle. This requires the user to wait for the dryer to complete its cycle before emptying the contents of the washer into the dryer. This wastes time.

Therefore, there is a need for a washing machine that can dry the clothes in an efficient manner so that it is more likely to complete its cycle in a better timed relationship to a dryer cycle.

Still further, many people having washing machines do not wish to purchase a new washing machine to take advantage of the latest technology associated with washing machines. However, energy saving is such an important consideration, everyone who can take advantage of an energy-saving device will want to have such a device.

Therefore, there is a need for an accessory that can be retro-fit onto existing washing machines whereby such existing machines can take advantage of the savings associated with improved technology.

PRINCIPAL OBJECTS OF THE INVENTION

It is a main object of the present invention to provide a clothes washing machine that has a spin-dry cycle that has efficiency improved over the efficiency of presently available washing machine spin-dry cycles.

It is another object of the present invention to provide a washing machine that can complete its washing cycle in an efficient manner so that it is more likely to complete its cycle in a better timed relationship to a dryer cycle.

It is another object of the present invention to provide an accessory that can be retro-fit onto existing washing machines whereby such existing machines can take advantage of the savings associated with improved technology.

SUMMARY OF THE INVENTION

These, and other, objects are achieved by an accessory for use on a clothes washing machine that produces air flow over clothes undergoing a spin dry cycle in the washing machine. The air flow from the accessory is added to any air flow that normally occurs in such a spin-dry cycle and increases the efficiency of the washing machine. The accessory includes fan blades that are stored out of the way so articles can be easily placed into the machine and removed from the machine, and automatically moves into a deployed configuration when the washing machine is in a spin-dry cycle.

One form of the invention uses centrifugal force to deploy the accessory into its operational configuration. The accessory includes a fan with fan blades that are oriented to move air into the washing machine tub and over the articles in the tub during the spin-dry cycle. Air ports can be included in the door of the washing machine to facilitate the flow of air created by the fan.

The increased air flow associated with the fan increases the drying efficiency of the washing machine spin cycle and thus decreases the time required to effect the spin-dry cycle. This dries the articles more efficiently than is possible using presently known machines. Drier articles, such as clothes, from the washing machine reduces the time required for a dryer, and the number of dryer cycles required, to fully dry clothes. This is especially true for heavy loads, such as jeans and towels. The drier articles in the washing machine also reduces the possibility of mold forming on any articles that are left in the washing machine, and even makes the articles cleaner-smelling when they are removed from the washing machine.

The accessory can be sold with the machine as original equipment or easily added onto existing equipment thereby increasing the versatility of the accessory.

A modified embodiment of the accessory of the present invention includes a body having a top and one or more sides, wherein said body is structured to telescopically mount on an upper extremity of the agitator of a clothes washing machine. The accessory includes a plurality of vanes attached to the body wherein the plurality of vanes are equidistantly spaced about and extending radially outwardly from the body, and wherein each of the vanes includes an inner edge having an upper end and a lower end, an outer edge, and a central portion extending from the inner edge to the outer edge. The accessory also includes an encircling element having a band-like structure secured to the outer edge of each of the vanes, The present invention also includes a cover door on the clothes washing machine wherein the cover door has a plurality of air flow ports defined therethrough. The vanes are structured to cause air to be circulated along the agitator of the clothes washing machine and through the air flow ports of the cover door during a spin-dry cycle of the clothes washing machine.

The invention includes a method for enhancing air circulation in a clothes washing machine during the spin-dry cycle to thereby reduce the drying time subsequently needed for drying the clothes.

DETAILED DESCRIPTION OF THE INVENTION

Figure 1:
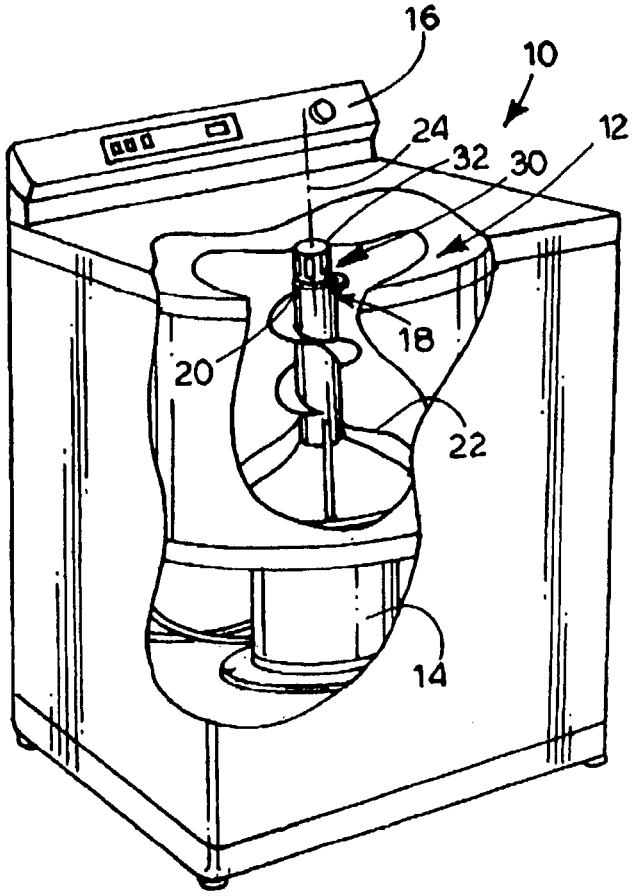
FIG. 1 is a perspective view of a washing machine having an accessory embodying the present invention installed thereon.

Other objects, features and advantages of the invention will become apparent from a consideration of the following detailed description and the accompanying drawings.

The accessory embodying the teaching of the present invention increases the efficiency of the spin-dry cycle of a washing machine by increasing the air flow through the washing machine tub during the drying cycle. The accessory assumes a stored configuration when it is not in use so that it is out of the way when articles are inserted into or removed from the washing machine. However, the accessory automatically assumes a deployed operational configuration when the washing machine operates in a drying cycle.

As shown in FIGS. 1–12, the disclosed invention includes a clothes washing machine 10 comprising: a clothes washing tub 12 located inside the machine 10 which is operated by a motor 14 and controlled by suitable switches located on a control panel 16 in the manner known in the art so that articles inserted into machine 10 via a door (not shown in FIG. 1) will be first subjected to a washing cycle, then a rinsing cycle, and then a drying cycle in accordance with the settings of the controls on control panel 16. Washing machine 10 further includes an agitator 18 located in clothes washing tub 12, with agitator 18 having a top end 20, a bottom end 22 and a longitudinal dimension 24 extending between the top end 20 of agitator 18 and bottom end 22 of agitator 18.

The foregoing portions of washing machine 10 are standard, and thus will not be further discussed. To increase the efficiency of the spin-dry cycle, the present invention further includes an accessory 30 that can be included with washing machine 10 as an original factory-installed item when the washing machine 10 is sold, or can be retro-fit onto an existing machine 10 and, as such, will be sold in kit form.

Figure 2:
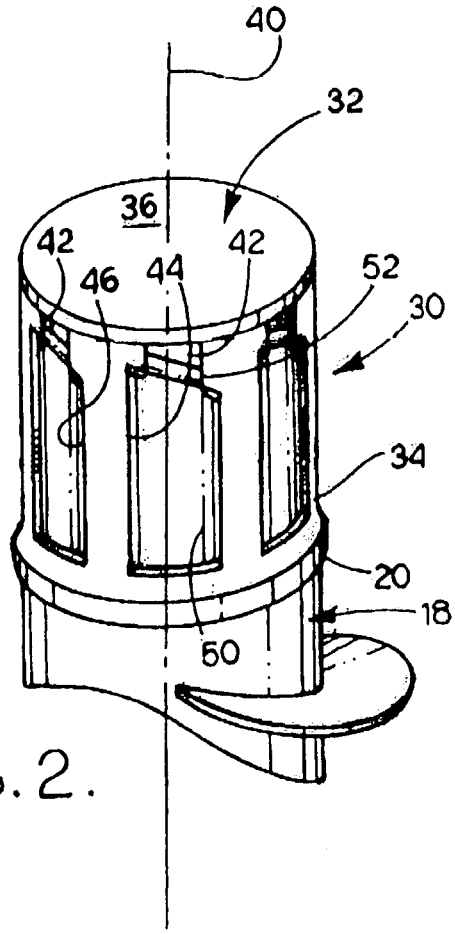
FIG. 2 is an enlarged perspective view of an accessory embodying the present invention installed on top of an agitator of a washing machine in accordance with the teaching of the present invention.

Accessory 30 comprises a body 32 which, in the use configuration, is mounted on top of agitator 18. Body 32 includes a bottom end 34 which, in use, is mounted on top of agitator 18 and a top end 36 spaced from bottom end 34 of body 32 along longitudinal dimension 24 of agitator 18 when body 32 is mounted on agitator 18 as shown in FIGS. 1 and 2. Accessory 30 further includes a longitudinal dimension 40 which extends between top end 36 of body 32 and bottom end 34 of body 32 and which, in the preferred form of the invention, is co-linear with longitudinal dimension 24 of agitator 18. Accessory 30 further includes a plurality of fan blade accommodating chambers, such as fan blade accommodating chamber 42, defined in body 32 to extend along the longitudinal dimension 40 of body 32. Each fan blade accommodating chamber 42 includes side walls 44 and 46 which extend along longitudinal dimension 40 and a rear wall 47.

Figure 4:
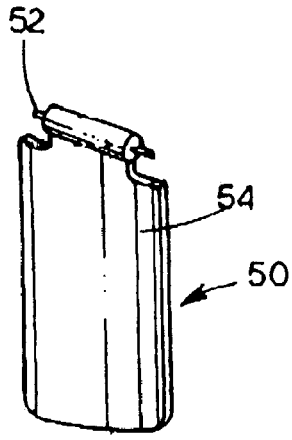
FIG. 4 is a perspective view of a fan blade that is used in the accessory of the present invention.

A plurality of fan blades, such as fan blade 50, are movably mounted on body 32. As shown in FIGS. 1, 2 and 4, each fan blade includes a pivot pin 52 mounted on two adjacent side walls 44, 46 and spaced from rear wall 47 of each fan blade accommodating chamber 42. Pivot pin 52 is oriented to extend across the fan blade accommodating chamber 42 at an oblique angle to the side walls 44, 46 of the fan blade accommodating chamber 42 in which the pivot pin 52 is mounted to be oriented at an oblique angle with respect to the longitudinal dimension 24 of the agitator 18. In the preferred form of the accessory, this oblique angle is approximately 40°, but other angles could be used in accordance with the teaching of the present invention as will occur to those skilled in the art based on the teaching of the present disclosure. The purpose of the oblique angle will be understood from the following disclosure.

Figure 5:
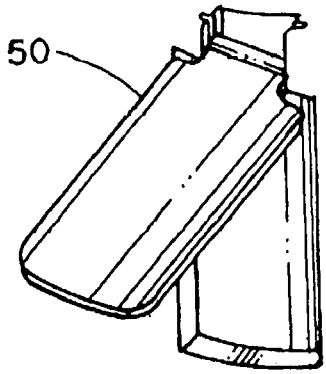
FIG. 5 shows a schematic view of a fan blade in a deployed configuration.
Figure 8:
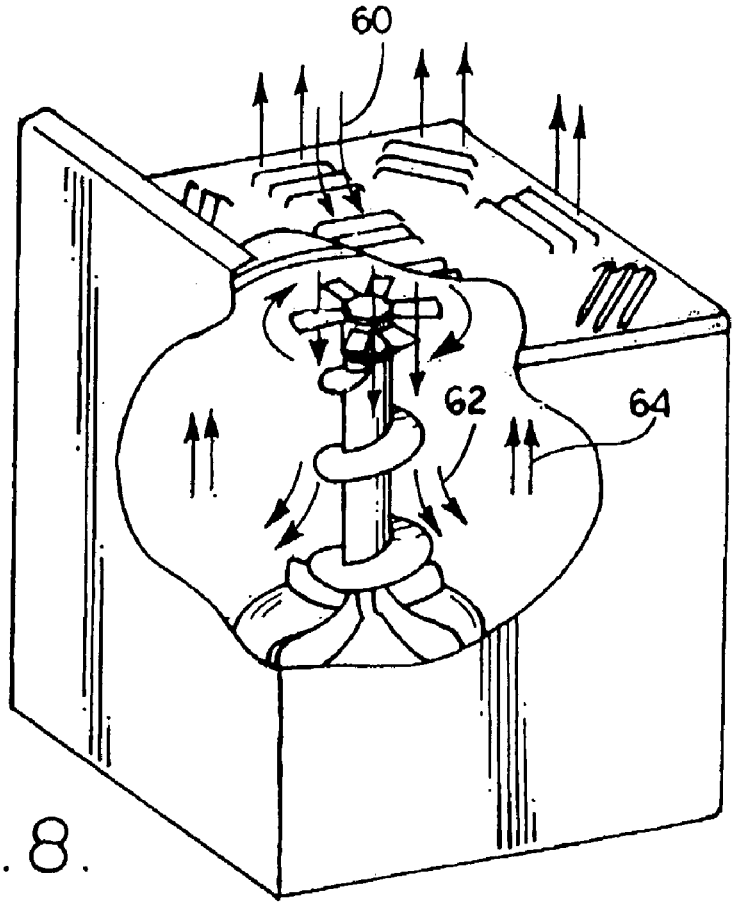
FIG. 8 shows the air flow pattern established by the accessory of the present invention.
Figure 9:
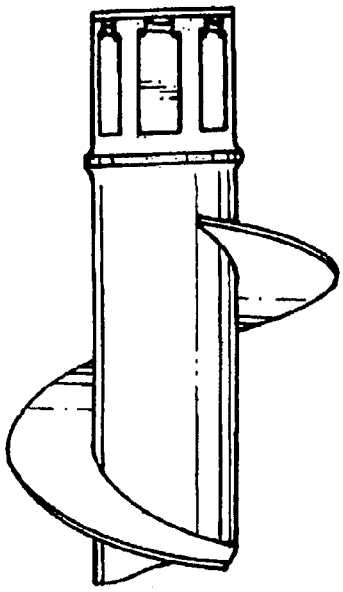
FIG. 9 shows an agitator of a washing machine with the fan blades of the accessory of the present invention in a stored configuration.
Figure 10:
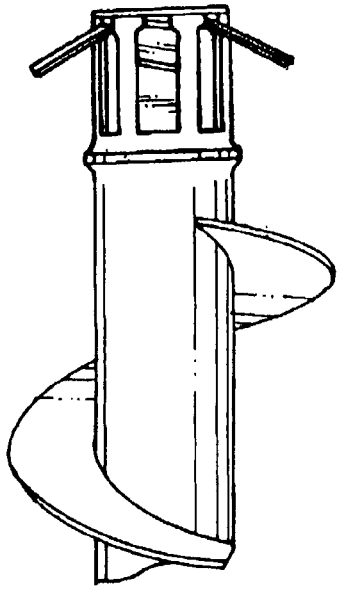
FIG. 10 shows an agitator of a washing machine with the fan blades of the accessory of the present invention in a deployed configuration.
Figure 11:
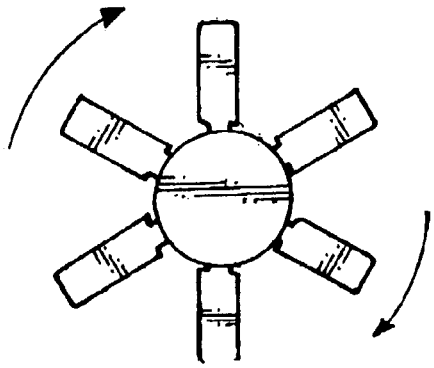
FIG. 11 is a top plan view of a fan of the accessory of the present invention in a deployed configuration.
Figure 12:
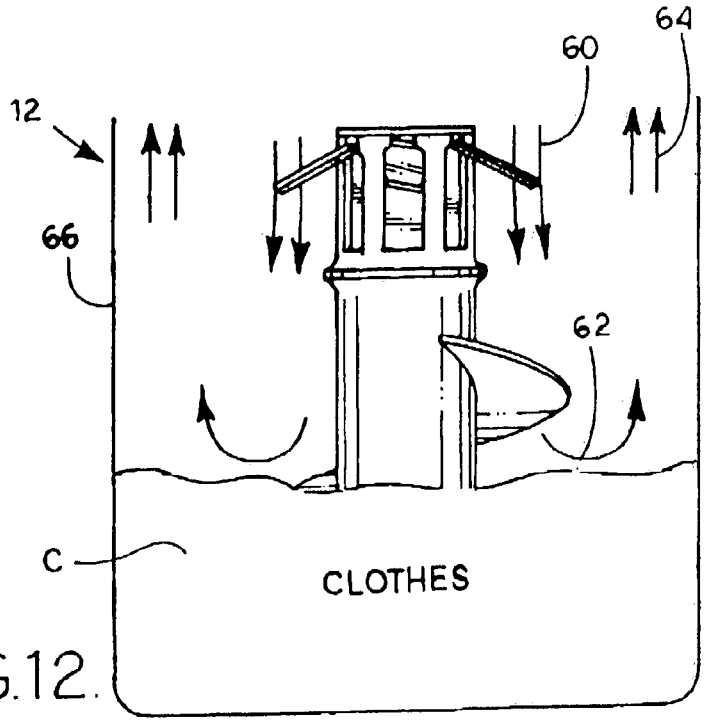
FIG. 12 shows the fan blades of the accessory of the present invention in a deployed configuration and the resulting air flow pattern established during a spin-dry cycle of a washing machine that is equipped with the accessory.

Accessory 30 further includes a plurality of fan blade bodies, such as fan blade body 54, with each fan blade body 54 being pivotally connected to an associated pivot pin 52 to move between a rest configuration shown in FIG. 9 extending along the longitudinal dimension 40 of body 32 and a deployed configuration shown in FIGS. 8, 10, 11 and 12 extending outwardly from body 32. The oblique orientation of the pivot pins 52 cause the deployed fan blade bodies 54 to be oriented at a pitch angle with respect to body 32 as indicated in FIGS. 5, 10 and 12. In the deployed configuration of the fan blades 50, the fan blade bodies 54 extend outwardly from body 32 as shown in FIGS. 5, 8, 10, 11 and 12. In addition to the pitch angle of approximately 40°, the preferred form of the invention includes the fan blades 50 extending outwardly from body 32 at an angle of approximately 90° with respect to the surface of body 32 immediately adjacent to the fan blade 50 whereby the fan blades 50 extend radially outwardly from body 32.

The pitched and outwardly extending fan blades 50 thus adopt a configuration that moves air to, through and past accessory 30 in the manner shown in FIGS. 8 and 12. This air movement includes a first downward direction 60, a second outward direction 62 over any articles, such as clothing C, located in tub 12 and a third upward direction 64 along outer wall 66 of tub 12. This air flow increases the efficiency of a drying process occurring during the spin-dry cycle of washing machine 10.

As can be understood from the foregoing, the fan blades 50 assume an operational configuration as indicated in FIGS. 10 and 12 when agitator 18 begins to spin during the spin-dry cycle. Centrifugal force causes the fan blades 50 to move from the stored configuration shown in FIG. 9 to the deployed configuration shown in FIGS. 10 and 12. In the stored configuration, the fan blades 50 are out of the way and articles can be placed into tub 12 and removed from tub 12 without contacting the fan blades 50.

Figure 6:
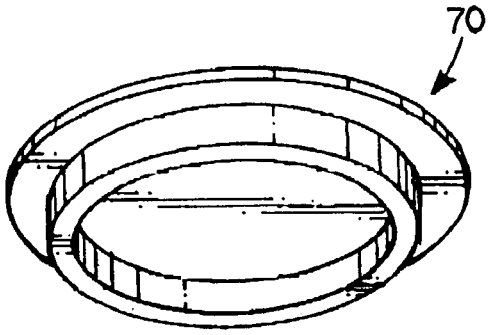
FIG. 6 shows a cap that can be used in connection with the accessory of the present invention.

A cap 70 is shown in FIG. 6 and is removably mounted on top end 36 of body 32 when the fan blade bodies 54 are in the rest configuration to ensure that the fan blade bodies 54 remain in the rest position.

Figure 3:
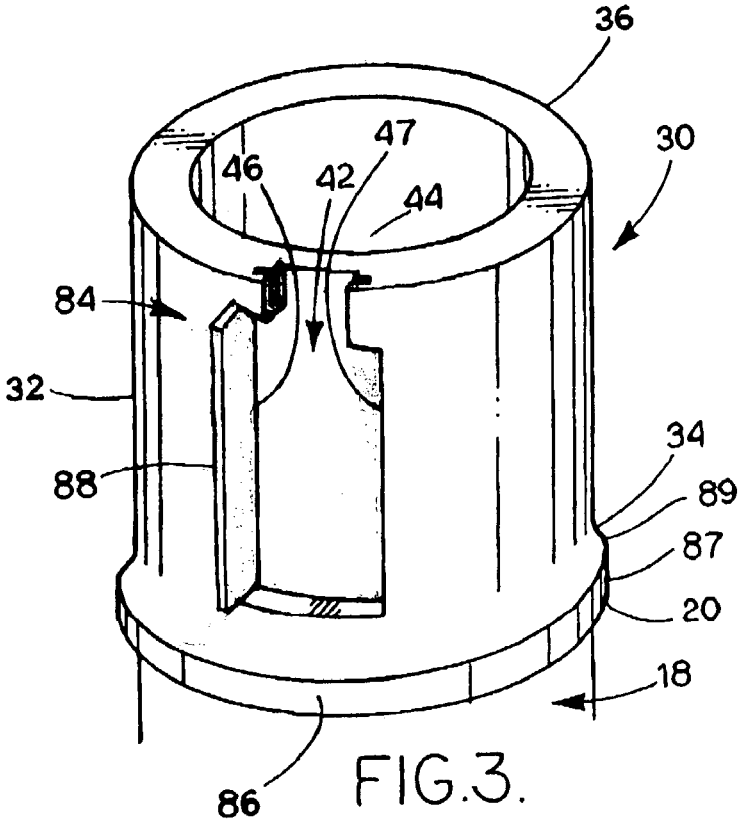
FIG. 3 is an enlarged view of an accessory of the present invention showing a groove in which a fan blade is accommodated.

To further ensure that the fan blade bodies 54 do not interfere with article movement into and out of tub 12, accessory 30 further includes a guard 84 on body 32 adjacent to and associated with each fan blade accommodating chamber 42. Each guard 84 extends outwardly from body 32 and each guard 84 includes a bottom portion 86 located near bottom end 34 of body 32 and a side portion 88 extending from bottom portion 86 of each guard 84 toward top end 36 of body 32 adjacent to side wall 46 of fan blade accommodating chamber 42 in which the associated fan blade 50 is located. The bottom portion 86 of the guard 84 can be a ledge defined by an offset orientation between body 32 and outer rim 87 of agitator 18. This offset orientation is indicated in FIG. 3 as ledge 89. In such a case, the ledge 89 extends generally completely around body 32.

Figure 7:
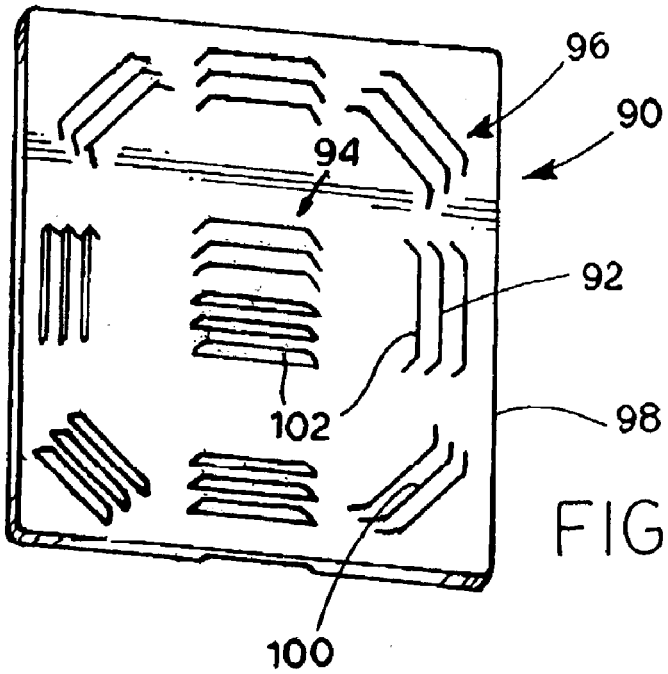
FIG. 7 shows a cover door for a washer that is equipped with the accessory of the present invention.

As discussed above, air moves into, through and out of the washing machine tub 12 during the drying cycle under the influence of accessory 30. In order to facilitate this air movement, washing machine 10 includes a cover door 90 on the clothes washing machine 10. The door 90 is best shown in FIG. 7 and includes a plurality of air flow ports, such as air flow port 92, defined therethrough. As can be seen in FIG. 7, plurality of air flow ports 92 includes a first group 94 of air flow ports 92 located to be adjacent to body 32 when cover door 90 is closed and body 32 is mounted on agitator 18. The plurality of air flow ports 92 further includes a second group 96 of air flow ports 92 located near outer perimeter 98 of cover door 90. As can be seen in FIG. 7, first group 94 of air flow ports 92 is centrally located on cover door 90 and the second group 96 of air flow ports 92 further includes a plurality of sub-groups 100 of air flow ports 92 with sub-groups 100 of air flow ports 92 being generally evenly arcuately spaced apart from each other. In the preferred form of door 90, sub-groups 100 are spaced apart from each other by arc lengths equal to approximately 45° whereby there are eight sub-groups 100 of air ports 92. However, any number and/or spacing associated with the sub-groups 100 and/or the central group 94 of air ports 92 can be used as will be understood by one skilled in the art based on the teaching of this disclosure without departing from the scope of this disclosure.

A louver, such as louver 102, is located on the door 90 adjacent to each air flow port 92 to direct air in the desired direction as indicated in FIGS. 7, 8 and 12.

Figure 15:
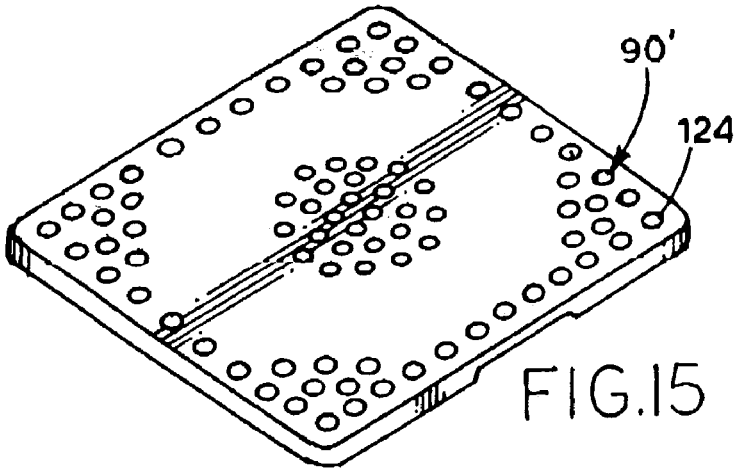
FIG. 15 shows another form of a washing machine door used in connection with the accessory of the present invention.
Figure 13:
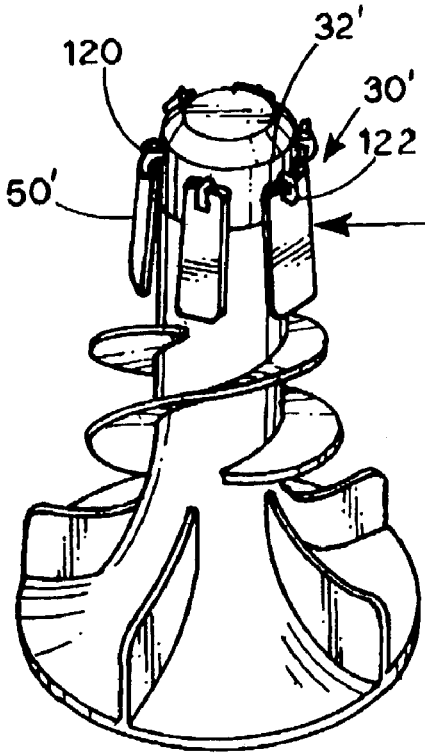
FIG. 13 is another form of the accessory on an agitator in accordance with the teaching of the present invention.
Figure 14:
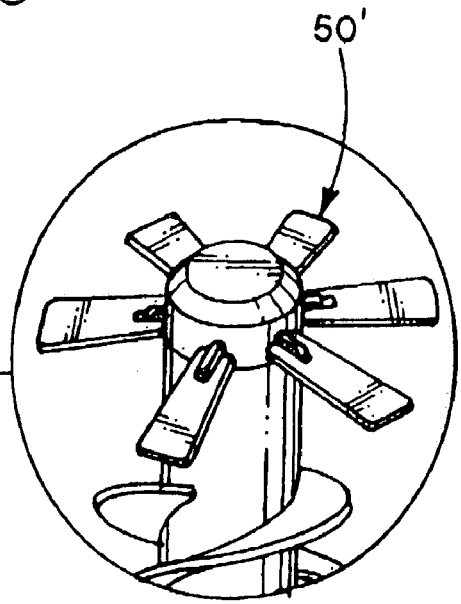
FIG. 14 is a perspective view of the accessory of the present invention with the fan blades thereof in a deployed configuration.
Figure 14A:
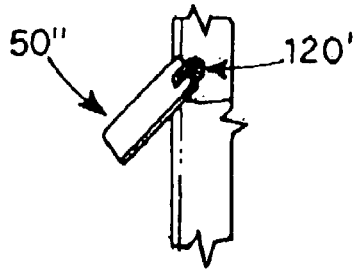
FIG. 14A shows a connection between a fan blade and an agitator that is alternative to the connection shown in FIG. 14.

An alternative form of the accessory is shown in FIGS. 13–15. Accessory 30' is similar to accessory 30, except that fan blades 50' are hingeably attached to body 32' by rings, such as ring 120 fitting through a ring opening, such as opening 122 on the fan blade 50'. Fan blades 50' do not automatically assume a pitch angle when in the deployed configuration shown in FIG. 14, but the rings 120' can be canted to effect such a pitched orientation of a fan blade 50" if desired. A pitched orientation of a fan blade 50" is shown in FIG. 14A to indicate this circumstance.

A further alternative for the accessory is shown in FIG. 15 with a cover door 90' where circular openings 124 have replaced the elongated air ports 92 shown in FIG. 7. Of course, doors 90 and 90' are interchangeable and each can be used with accessory 30 or accessory 30' or with fan blades 50" as will be understood by those skilled in the art based on the teaching of the present disclosure.

Figure 16:
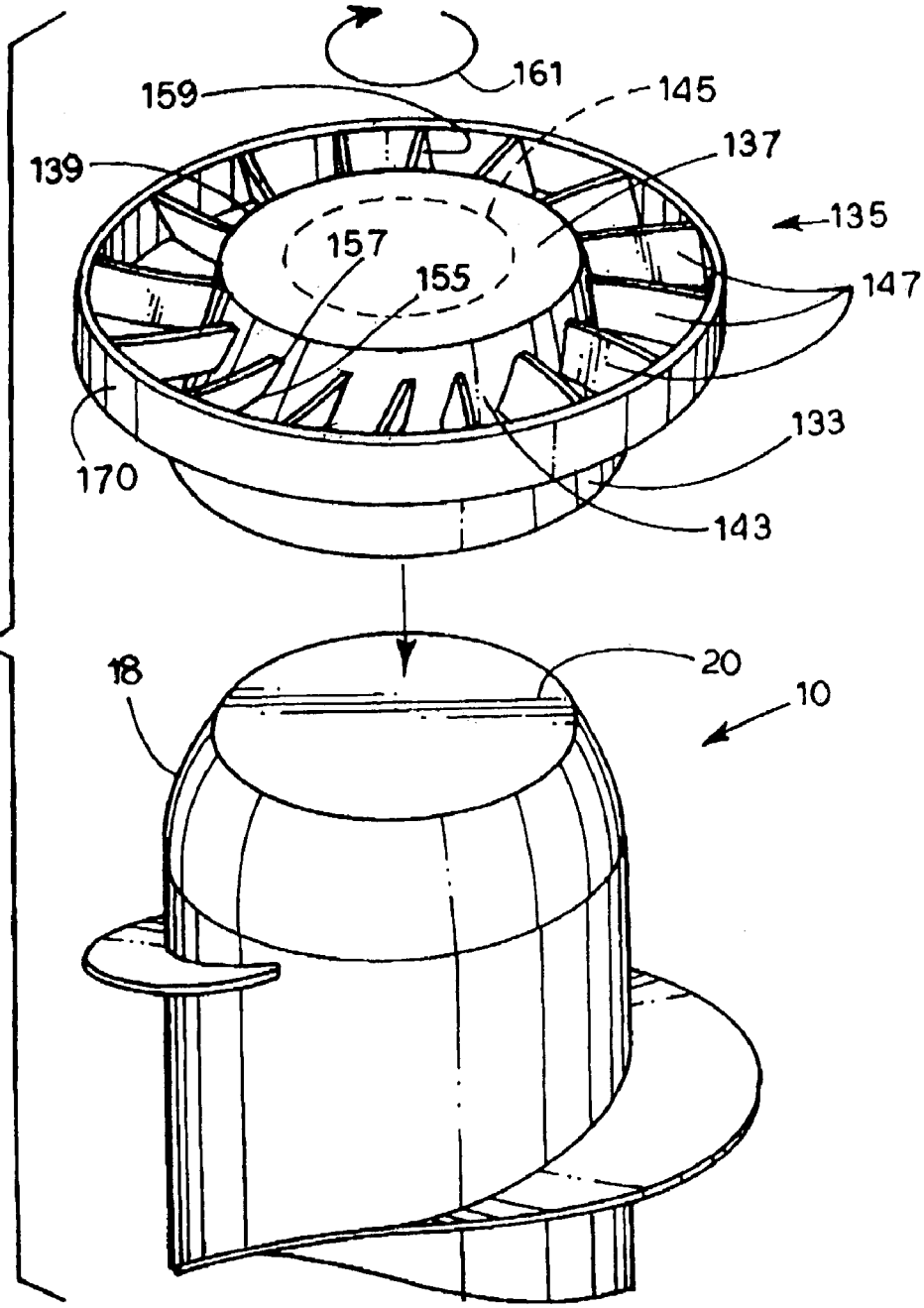
FIG. 16 is a perspective view of a modified embodiment of the air-circulation enhancer for a clothes washing machine in accordance with the present invention.

A modified embodiment of the air-circulation enhancer in accordance with the present invention is shown in FIGS. 16 through 23 and is generally designated by the numeral 130. Many of the characteristics of the modified embodiment 130 are similar to those of the previously described embodiments 90 and 90, and will not be reiterated here in detail. The device 130 comprises a body 133 and a fan mechanism 135, as shown in FIG. 16. The body 133 generally includes a top 137 with a perimeter 139 and sides 143. The sides 143 are symmetrical about longitudinal axis 144, somewhat similar to an inverted cup as shown in cross-section in FIG. 17, and is configured to conform to the profile of the top end 20 of the agitator 18 of a clothes washing machine 10 such that the body 133 can be slidingly placed over the top end 20 of the agitator 18.

Some clothes washing machines 10 have a dispenser (not shown) located within the agitator 18 wherein access to the dispenser is provided through the top end 20 of the agitator 18. In that event, the device 130 can be simply lifted off the agitator 18 in order to fill the dispenser or, alternatively, the top 137 can be provided with an opening, as indicated by the phantom line designated by the numeral 145 in FIG. 16, in order to provide access to the dispenser without having to remove the device 130.

The fan mechanism 135 includes a plurality of vanes 147 arranged in a turbine-like configuration. Each of the vanes 147 has an inner edge 153, with a lower end 155 and an upper end 157, and an outer edge 159. The inner edges 153 of the vanes 147 are secured to the body 133. The inner edges 153 form an acute angle with the perimeter 139. The vanes 147 are equidistantly spaced around the body 133 of the air-circulation enhancer 130. In one application of the present invention, the plurality of vanes 147 spaced equidistantly about the body 133 comprised fifteen of the vanes 147.

If it is desired that the air circulation enhancer 130 cause air to be circulated upwardly along the agitator 18 and downwardly along the clothes held centrifugally again the tub (not shown in FIG. 16) of the clothes washing machine 10 during the spin-dry cycle, the lower ends 155 of the vanes 147 lead the upper ends 157 of the vanes 147 in the direction of rotation of the agitator 18 during the spin-dry cycle, such as is shown in FIG. 16 for the direction of rotation as designated by the numeral 161. Conversely, it is to be understood that if it is desired that the air circulation enhancer 130 cause air to be circulated downwardly along the agitator 18 and upwardly along the clothes held centrifugally again the tub of the clothes washing machine 10 during the spin-dry cycle, the upper ends 157 of the vanes 147 lead the lower ends 155 of the vanes 147 in the direction of rotation 161 of the agitator 18 during the spin-dry cycle.

It should be obvious that for applications wherein the rotation is in the opposite direction from rotation 161, the angle at which the vanes 147 are attached to the body 133 is opposite to that for rotation 161, with the lower ends 155 of the vanes 147 structured to lead the upper ends 157 of the vanes 147 in the direction of rotation of the agitator 18 during the spin-dry cycle of the clothes washing machine 10 if it is desired that the air circulation enhancer 130 cause air to be circulated upwardly along the agitator 18 and downwardly along the clothes held centrifugally again the tub during the spin-dry cycle, and with the upper ends 157 of the vanes 147 structured to lead the lower ends 155 of the vanes 147 in the direction of rotation of the agitator 18 during the spin-dry cycle if it is desired that the air circulation enhancer 130 cause air to be circulated downwardly along the agitator 18 and upwardly along the clothes held centrifugally again the tub during the spin-dry cycle.

Generally, the vanes 147 extend horizontally outwardly from the body 133 approximately 1¼ inches and extend vertically approximately 1 inch. It is to be understood, however, that the vertical extent and/or the horizontal extent of the vanes 147 may be greater or lesser for any particular application.

Figure 18:
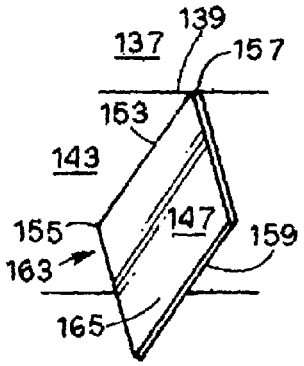
FIG. 18 is a fragmentary and schematic view of a vane of the modified embodiment of the air-circulation enhancer wherein a central portion, an inner edge, and an outer edge of the vane are coplanar.
Figure 19:
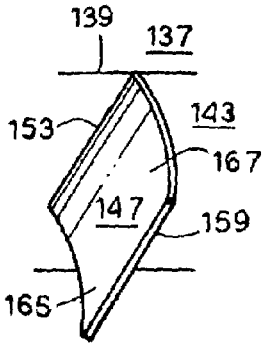
FIG. 19 is a fragmentary and schematic view of a vane of the modified embodiment of the air-circulation enhancer wherein a central portion thereof is cupped, and an inner edge and an outer edge thereof are coplanar.
Figure 20:
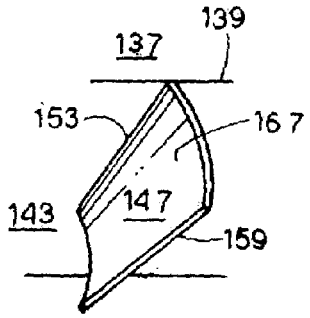
FIG. 20 is a fragmentary and schematic view of a vane of the modified embodiment of the air-circulation enhancer wherein a central portion thereof is cupped, and an inner edge and an outer edge thereof are non-coplanar.

For some applications, each vane 147 has a planar configuration 163 as shown in FIG. 18, with the outer edge 159 and inner edge 153 of each vane 147 being coplanar with each other and with a cental portion 165 extending between the inner edge 153 and outer edge 153 also being coplanar with the inner edge 153 and the outer edge 159. For other applications, the inner edge 153 and outer edge 159 of each vane 147 are coplanar with each other and the central portion 165 extending between the inner edge 153 and the outer edge 159 has a cupped configuration 167, as shown in FIG. 19. For yet other applications, the outer edge 159 and inner edge 153 of each vane 147 are not coplanar with each other, and the cental portion 165 extending between the outer edge 159 and inner edge 153 thereof has a cupped configuration 167, as shown in FIG. 20. The configurations shown in FIGS. 18 through 20 depict applications wherein the air-circulation enhancer 130 causes air to be circulated upwardly along the agitator 18 and downwardly along the clothes held centrifugally against the wall of the tub of the clothes washing machine 10 for rotation 161 of the agitator 18 in the spin-dry cycle.

Figure 21:
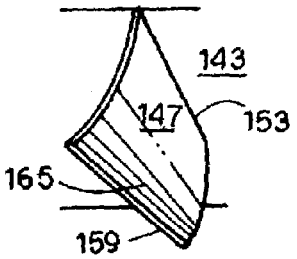
FIG. 21 is a fragmentary and schematic view of a vane of the modified embodiment of the air-circulation enhancer, similar to the version shown in FIG. 18, wherein a central portion, an inner edge, and an outer edge of the vane are coplanar.
Figure 22:
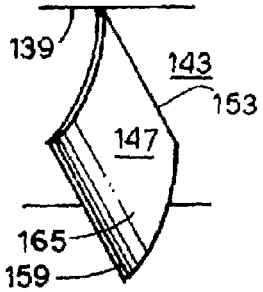
FIG. 22 is a fragmentary and schematic view of a vane of the modified embodiment of the air-circulation enhancer, similar to the version shown in FIG. 19, wherein a central portion thereof is cupped, and an inner edge and an outer edge thereof are coplanar.
Figure 23:
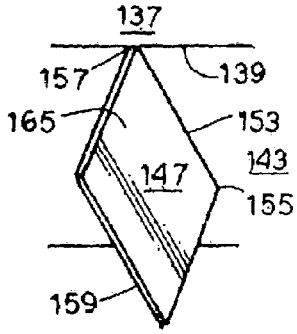
FIG. 23 is a fragmentary and schematic view of a vane of the modified embodiment of the air-circulation enhancer, similar to the version shown in FIG. 20, wherein a central portion thereof is cupped, and an inner edge and an outer edge thereof are non-coplanar.

Similar configurations depicting applications wherein the air-circulation enhancer 130 causes air to be circulated downwardly along the agitator 18 and upwardly along the clothes held centrifugally against the tub wall of the clothes washing machine 10 during the spin-dry cycle for rotation 161 of the agitator 18 are shown in FIGS. 21 through 23, as follows: planar central portion 165 and planar inner and outer edges 153, 159 as illustrated in FIG. 21 and corresponding to FIG. 18; cupped central portion 165 and planar inner and outer edges 153, 159 as illustrated in FIG. 22 and corresponding to FIG. 19; and cupped central portion 165 and non-planar inner and outer edges 153, 159 as illustrated in FIG. 23 and corresponding to FIG. 20.

Figure 17:
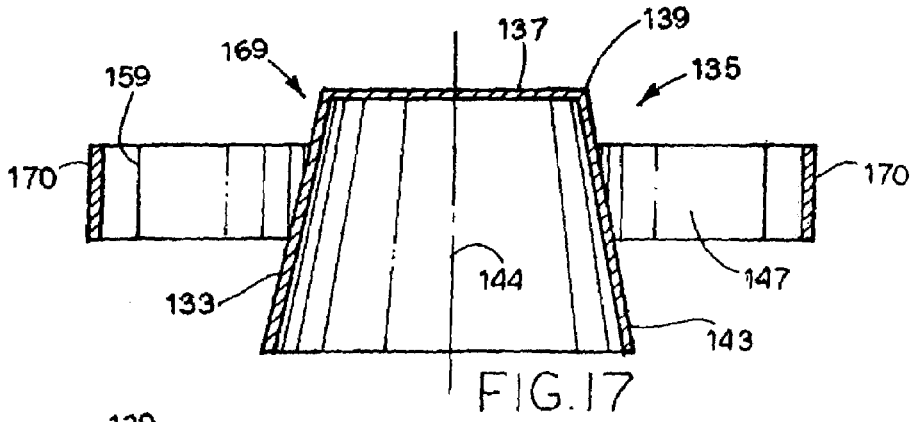
FIG. 17 is a cross-sectional view of the modified embodiment of the air-circulation enhancer for a clothes washing machine.

For some applications, it may be desirable to space the upper ends 157 of the vanes flush with the top 137 as shown in FIGS. 18 through 23 instead of spaced apart from the top 137 as shown in FIGS. 16 and 17 as designated by the numeral 169.

One advantage of configuring the vanes 147 such that air is caused to be circulated upwardly along the agitator 18 and downwardly along the clothes held centrifugally against the tub of the clothes washing machine, as opposed to being circulated downwardly along the agitator 18 and upwardly along the clothes held centrifugally against the tub during the spin-dry cycle, is due to the upward lifting force imposed on the air-circulation enhancer 130 during the spin-dry cycle for the latter circulation pattern. As a result, frictional engagement between the air-circulation enhancer 130 and the agitator 18 may suffice for applications wherein the air-circulation enhancer 130 is configured to cause air to be circulated upwardly along the agitator 18 and downwardly along the clothes held centrifugally against the tub of the clothes washing machine 10, whereas for some applications wherein the air-circulation enhancer 130 is configured to cause air to be circulated downwardly along the agitator 18 and upwardly along the clothes held centrifugally against the tub, the air-circulation enhancer 130 may have to be secured to the agitator 18.

For some applications, it may be desirable to provide a continuous encircling element 170 having a band-like configuration that is attached to the outer edges 159 of the vanes 147, as shown in FIGS. 16 and 17. Such an encircling element 170 provides additional structural support to the vanes 147. Such an encircling element 170 also provides a shield to prevent clothes, being placed into or removed from the clothes washing machine 10, from snagging on the vanes 147 during those occasions wherein the air-circulation enhancer 130 is not removed from the agitator 18 while performing those tasks. Further, such an encircling element 170 provides a guard to prevent injury to a user's hands by preventing contact with the vanes 147 as clothes are being placed into or removed from the clothes washing machine 10 during those occasions wherein the air-circulation enhancer 130 is not removed from the agitator 18 while those tasks are being performed.

Use of the modified embodiment 130 is substantially similar to the use of the other embodiments hereinbefore described.

It is understood that while certain forms of the present invention have been illustrated and described herein, it is not to be limited to the specific forms or arrangements of parts described and shown.

The invention claimed is:

1. An air circulation-enhancing accessory for a clothes washing machine having an agitator and a spin-dry cycle, the accessory comprising:

a) a body having a top and one or more sides, wherein said body is structured to telescopically mount on an upper extremity of the agitator of the clothes washing machine;

b) a plurality of vanes attached to said body, said plurality of vanes equidistantly spaced about and extending radially outwardly from said body, wherein each of the vanes of said plurality of vanes includes (1) an inner edge having an upper end and a lower end, (2) an outer edge, and (3) a central portion extending from said inner edge to said outer edge;

c) an encircling element having a band-like structure secured to the outer edge of each of the vanes of said plurality of vanes; and d) a cover door on the clothes washing machine, said cover door having a plurality of air flow ports defined therethrough; and e) wherein (1) said central portion of each vane of said plurality of vanes is cupped, and said inner edge and said outer edge of each vane of said plurality of vanes are coplanar, (2) said upper end of each of the vanes of said plurality of vanes leads the respective lower end of each vane of said plurality of vanes in the direction of rotation of the agitator during a spin-dry cycle of the clothes washing machine, (3) the upper end of each vane of said plurality of vanes is offset downwardly from said top of said body, and (4) said plurality of vanes are structured to cause air to be circulated downwardly along the agitator and through the air flow ports of said cover door during a spin-dry cycle of the clothes washing machine.

2. A method of enhancing air circulation during a spin-dry cycle of a clothes washing machine, comprising the steps of:

a) providing an accessory for the clothes washing machine, the accessory having a turbine-like structure;

b) providing a cover door for the clothes washing machine, the cover door having a plurality of air flow ports therethrough; and c) mounting the accessory on the agitator of the clothes washing machine such that air is caused to circulate along the agitator and through the air flow ports of the cover door during a spin-dry cycle of the clothes washing machine.

3. An air circulation-enhancing accessory for a clothes washing machine having an agitator and a spin-dry cycle, the accessory comprising:

a) a body structured to mount on an upper extremity of the agitator of the clothes washing machine; and b) a plurality of vanes attached to said body, said plurality of vanes equidistantly spaced about and extending radially outwardly from said body; and c) wherein each of the vanes of said plurality of vanes has an inner edge with an upper end and a lower end, and wherein said lower ends of said vanes are structured to lead said upper ends of said vanes in the direction of rotation of the agitator during a spin-dry cycle of the clothes washing machine.

4. An air circulation-enhancing accessory for a clothes washing machine having an agitator and a spin-dry cycle, the accessory comprising:

a) a body structured to mount on an upper extremity of the agitator of the clothes washing machine; and b) a plurality of vanes attached to said body, said plurality of vanes equidistantly spaced about and extending radially outwardly from said body; and c) wherein each of the vanes of said plurality of vanes has an inner edge with an upper end and a lower end, and wherein said upper ends of said vanes are structured to lead said lower ends of said vanes in the direction of rotation of the agitator during a spin-dry cycle of the clothes washing machine.

5. An air circulation-enhancing accessory for a clothes washing machine having an agitator and a spin-dry cycle, the accessory comprising:

a) a body structured to mount on an upper extremity of the agitator of the clothes washing machine; and b) a plurality of vanes attached to said body, said plurality of vanes equidistantly spaced about and extending radially outwardly from said body; and c) wherein each of the vanes of said plurality of vanes has an inner edge, an outer edge, and a central portion extending from said inner edge to said outer edge, and wherein said central portion is cupped, and said inner and outer edges are not coplanar.

6. An air circulation-enhancing accessory for a clothes washing machine having an agitator and a spin-dry cycle, the accessory comprising:

a) a body structured to mount on an upper extremity of the agitator of the clothes washing machine;

b) a plurality of vanes attached to said body, said plurality of vanes equidistantly spaced about and extending radially outwardly from said body; and c) an encircling element secured to an outer extremity of each of the vanes of said plurality of vanes.

7. An air circulation-enhancing accessory for a clothes washing machine having an agitator and a spin-dry cycle, the accessory comprising:

a) a body structured to mount on an upper extremity of the agitator of the clothes washing machine; and b) a plurality of vanes attached to said body, said plurality of vanes equidistantly spaced about and extending radially outwardly from said body; and c) wherein each of the vanes of said plurality of vanes has an inner edge with an upper end, and wherein said upper ends of said vanes are offset downwardly from an upper extremity of said body.

8. An air circulation-enhancing accessory for a clothes washing machine having an agitator and a spin-dry cycle, the accessory comprising:

a) a body structured to mount on an upper extremity of the agitator of the clothes washing machine;

b) a plurality of vanes attached to said body, said plurality of vanes equidistantly spaced about and extending radially outwardly from said body; and c) a cover door on the clothes washing machine, wherein said cover door includes a plurality of air flow ports defined therethrough.

* * * * *